US008146206B2

(12) United States Patent
Lautenschläger

(10) Patent No.: US 8,146,206 B2
(45) Date of Patent: Apr. 3, 2012

(54) FURNITURE HINGE HAVING A DAMPING DEVICE

(76) Inventor: Horst Lautenschläger, Reinheim (DE)

( * ) Notice: Subject to any disclaimer, the term of this patent is extended or adjusted under 35 U.S.C. 154(b) by 215 days.

(21) Appl. No.: 12/443,532

(22) PCT Filed: Aug. 27, 2007

(86) PCT No.: PCT/EP2007/007479

§ 371 (c)(1),
(2), (4) Date: Mar. 30, 2009

(87) PCT Pub. No.: WO2008/043409

PCT Pub. Date: Apr. 17, 2008

(65) Prior Publication Data

US 2009/0313789 A1 Dec. 24, 2009

(30) Foreign Application Priority Data

Oct. 6, 2006 (DE) ..... 10 2006 047 315

(51) Int. Cl.
*E05F 1/08* (2006.01)

(52) U.S. Cl. ..... 16/286

(58) Field of Classification Search ..... 16/50, 54, 16/56, 58, 250, 51, 66

See application file for complete search history.

(56) References Cited

U.S. PATENT DOCUMENTS

| | | | | |
|---|---|---|---|---|
| 769,201 | A | 9/1906 | Van Blarcom et al. | |
| 1,131,121 | A * | 3/1915 | Daly | 16/68 |
| 3,975,791 | A * | 8/1976 | Hettich et al. | 16/294 |
| 4,422,214 | A * | 12/1983 | Lautenschlager et al. | 16/291 |
| 5,417,446 | A * | 5/1995 | Pileggi | 280/276 |
| 5,500,983 | A * | 3/1996 | Lautenschlager | 16/304 |
| 7,275,284 | B2 * | 10/2007 | Lautenschlager et al. | 16/287 |
| 7,360,804 | B1 * | 4/2008 | Fidali et al. | 292/262 |
| 7,562,416 | B2 * | 7/2009 | Lautenschlager et al. | 16/286 |
| 7,600,295 | B2 * | 10/2009 | Zimmer | 16/286 |
| 2003/0200625 | A1 * | 10/2003 | Zimmer | 16/306 |
| 2005/0015927 | A1 * | 1/2005 | Kropf | 16/286 |

FOREIGN PATENT DOCUMENTS

| | | | |
|---|---|---|---|
| DE | 9210092 | U1 | 9/1992 |
| WO | 2004020771 | A | 3/2004 |

OTHER PUBLICATIONS

International Search Report for corresponding International Application PCT/EP2007/007479.

* cited by examiner

*Primary Examiner* — Victor Batson
*Assistant Examiner* — Matthew Sullivan
(74) *Attorney, Agent, or Firm* — WRB-IP LLP

(57) ABSTRACT

A furniture hinge has a door stop part, which includes an insertion cup and is attached on a furniture door, at least one pivoting arm that is connected to a furniture body being supported on the door stop part. A damping device including at least one damping cylinder engages in the door stop part. Each damping cylinder is disposed at least partially in a bore of the furniture door. The cylinder axis of the damping cylinder extends substantially perpendicularly to the door plane. The damping cylinder is moved during the pivoting thereof into the locking position of the furniture door by the pivoting arm.

20 Claims, 10 Drawing Sheets

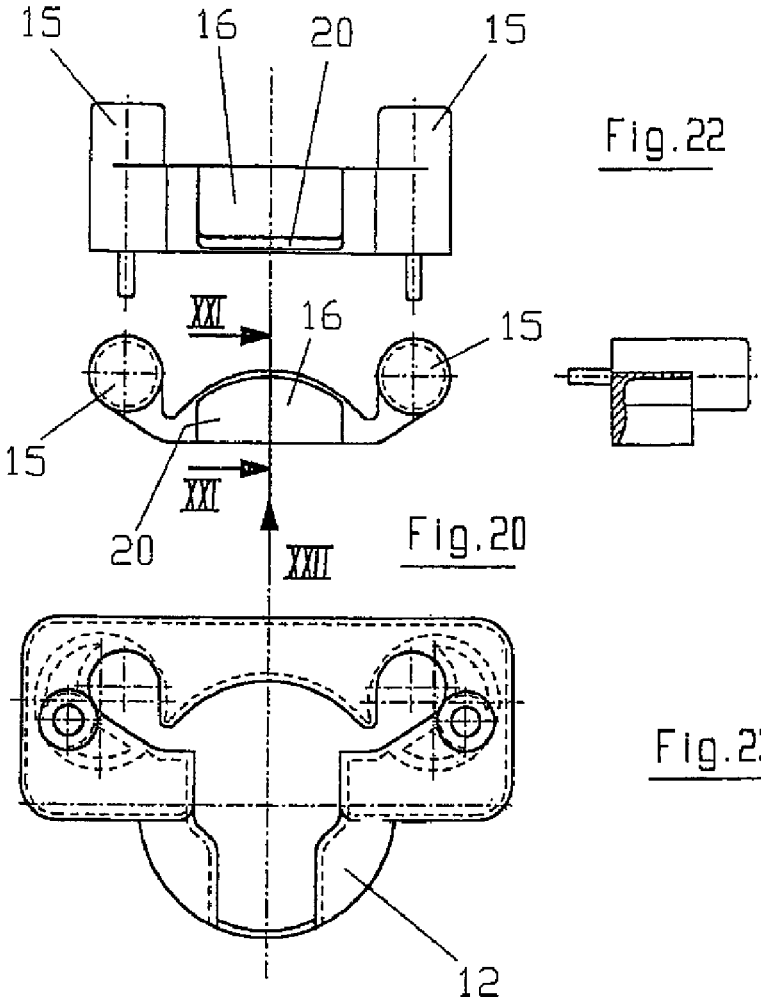
Fig.22
Fig.21
Fig.20
Fig.23
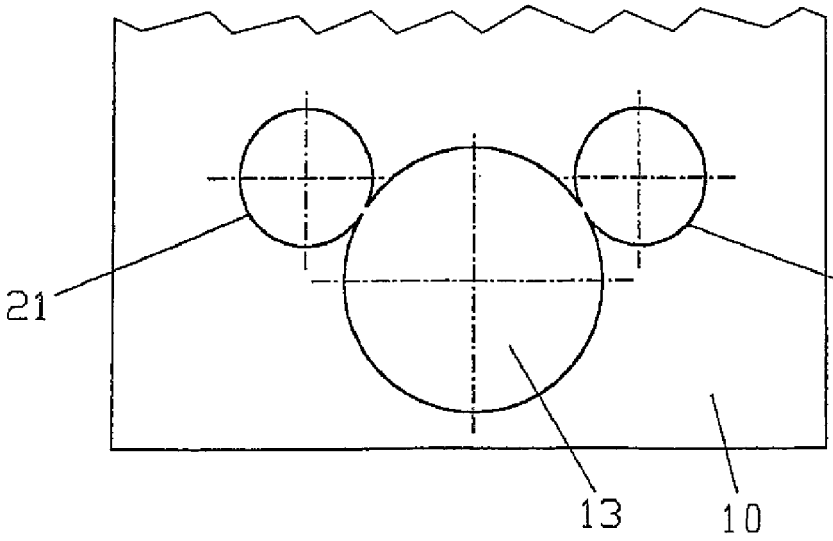
Fig.19

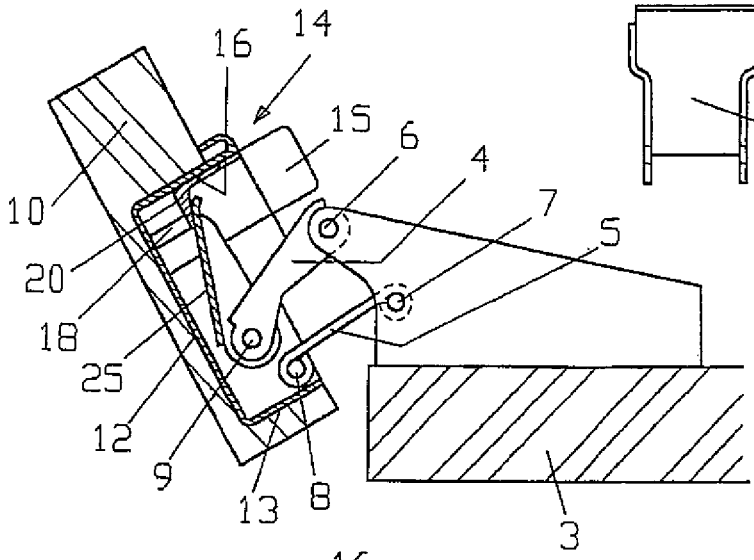
Fig.26
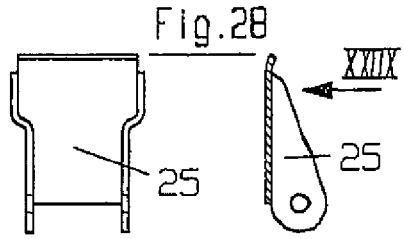
Fig.28
Fig.27
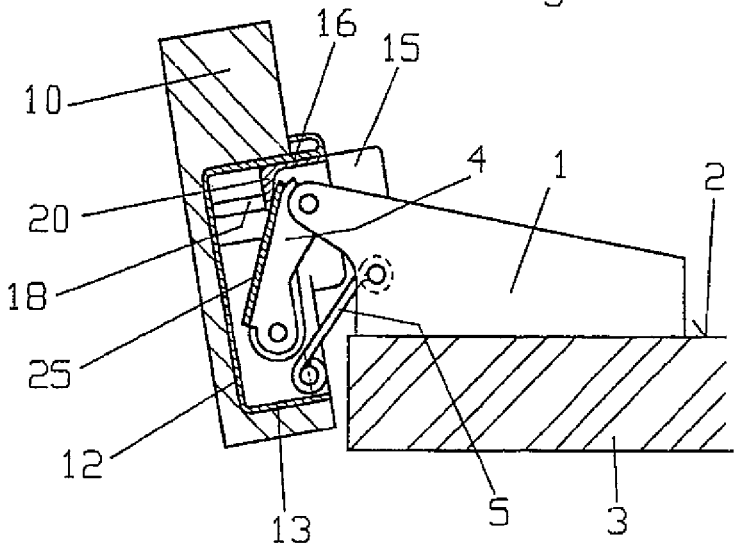
Fig.25
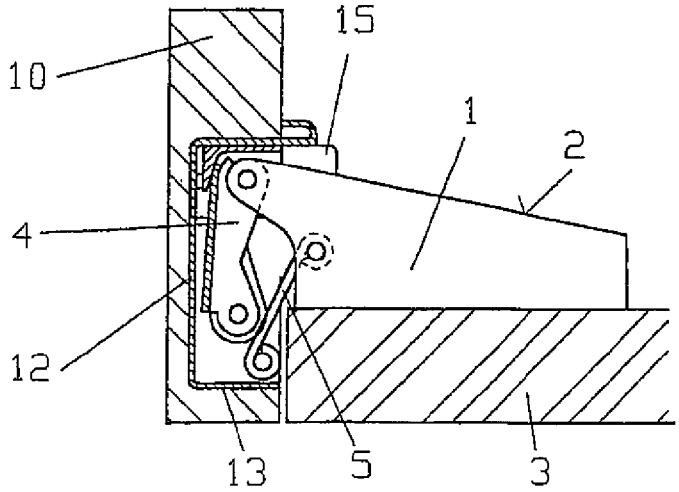
Fig.24

Fig.30
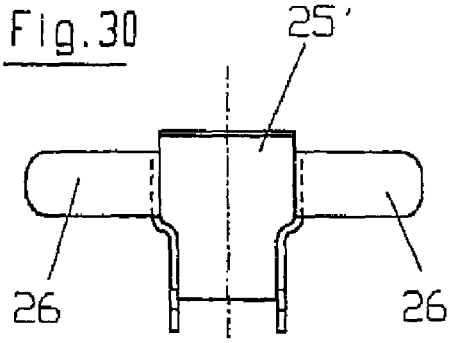
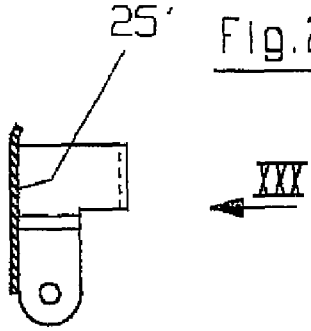
Fig.29
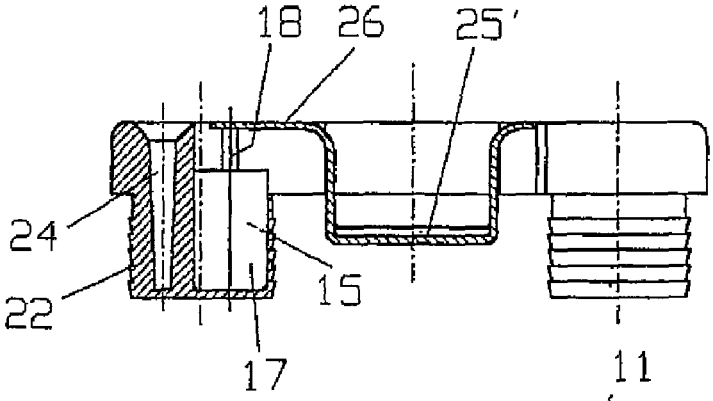
Fig.31
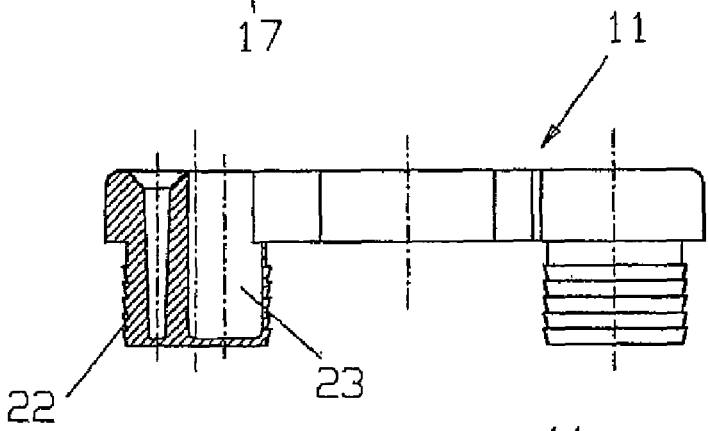
Fig.32
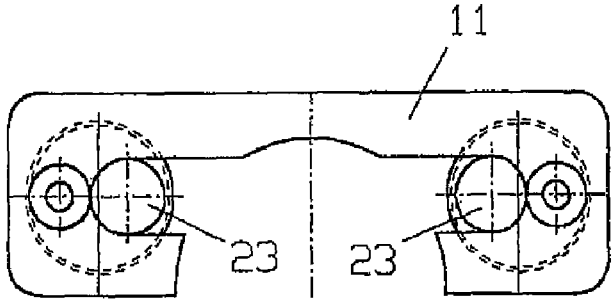
Fig.33

FURNITURE HINGE HAVING A DAMPING DEVICE

BACKGROUND AND SUMMARY

The invention concerns a furniture hinge that has a door stop part that comprises an insertion cup and is attached on a furniture door, on which a pivoting arm that is connected to a furniture body is arranged, and that comprises a damping device having at least one damping cylinder that engages in the door stop part.

Particularly during quick closing motions, the closing force that a furniture hinge exerts on the furniture door that is to be closed results in the furniture door slamming shut on the furniture body. In an effort to reduce the impact effect and the resulting noise, it is known to arrange buffers on the furniture body or on the furniture door. However, because said buffers necessarily must be thin, this only results in a minor reduction of the impact effect.

Therefore, it is known to arrange a damping device on the furniture hinge with which the furniture door makes contact at the end of its closing motion. The damping device comprises a damping cylinder with whose piston rod the furniture door or a fitting attached thereon makes contact so that the furniture door is slowed down until it is fully closed. Since the damping effect of the damping cylinders is velocity-dependent, the damping device does not exert any force on the furniture door when the furniture door is closed, which means that the furniture door stays in the closed position.

In a known furniture hinge as described in the introduction (EP 1 538 293 B1) the damping device is arranged on the stop part of the body and engages with the door stop part. In another known furniture hinge equipped with a damping device (US 2004/0205935 A1) as described in the introduction, the piston rod of the damping cylinder of the damping device arranged on the body stop part extends in the direction of the furniture door. When the furniture door is being closed, its door stop part makes contact with the exposed end of the piston rod so that the motion of the furniture door is dampened.

The known embodiments of furniture hinges combined with a damping device have in common that the additional space that is required for the damping device is considerable. The available inside space of the furniture body is reduced due to the damping device that extends into it.

It is desirable to provide a furniture hinge with a damping device as described in the introduction in which no or only very limited additional visible space is required for the damping device.

According to an aspect of the invention a damping device comprises one, preferably two parallel damping cylinders that are arranged, at least partially, in bores of the furniture door, in that the cylinder axes of the damping cylinders extend essentially perpendicular to the door plane and in that the damping cylinders are moved by means of the pivoting arm during its pivoting motion into the closed position of the furniture door.

Since the damping cylinders are largely arranged in bores of the furniture door, they do not require any additional space and in particular do not extend into the interior space of the furniture body. No additional components are required for the body stop part to move the damping device. The existing pivoting arm that is arranged on the insertion cup is used for this purpose.

In an embodiment of the furniture hinge as a multi-joint furniture hinge the pivoting arm is one of the two hinge control arms.

In an embodiment of the furniture hinge as a single-joint furniture hinge the support arm that is arranged on the insertion cup and is connected to the furniture body represents the pivoting arm that acts on the damping device and carries out a pivoting motion during the closing motion of the furniture door.

One or both of the damping cylinders of the damping device can at least partially be arranged within a cup bore in the furniture door that accommodates the insertion cup. The cup bore usually provides sufficient space for this so that no additional bore is needed to accommodate the damping cylinders.

It also is possible to arrange each damping cylinder at least partially in a bore of the furniture door that is arranged next to the cup bore.

The damping cylinders may also be arranged at least partially in a peg bore that accommodates a fastening peg of the door stop part. Although this requires a larger peg bore compared to customary peg bores, the costs of making the bore are the same.

BRIEF DESCRIPTION OF THE DRAWINGS

The invention is explained in more detail with the help of exemplary embodiments that are shown in the drawing. Specifically:

FIG. 19 shows a bore according to FIG. 4 for a modified embodiment, FIG. 20 shows a top view according to FIG. 10, FIG. 21 shows a section along line XXI-XXI in FIG. 20, FIG. 22 shows a view in the direction of arrow XXII in FIG. 20, FIG. 23 shows a top view according to FIG. 9, FIGS. 24-26 show sectional views according to FIGS. 1-3 with a modified embodiment of a furniture hinge, FIG. 27 shows a detailed drawing of the pivoting flap used according to FIGS. 24-26, FIG. 28 shows a view in the direction of arrow XXIIX in FIG. 27, FIGS. 29-33 show parts of a modified embodiment of a door stop part.

DETAILED DESCRIPTION

Figure 1:
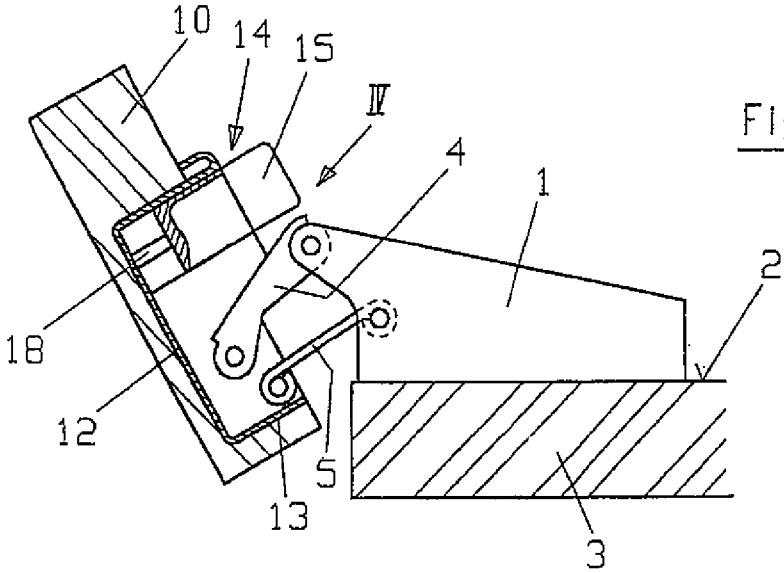
FIGS. 1-3 each show a horizontal view of a furniture hinge in consecutive positions while the furniture door is being closed.
Figure 2:
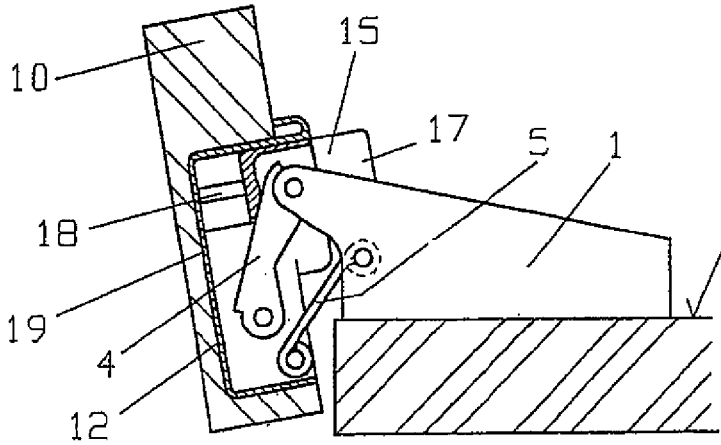
Figure 3:
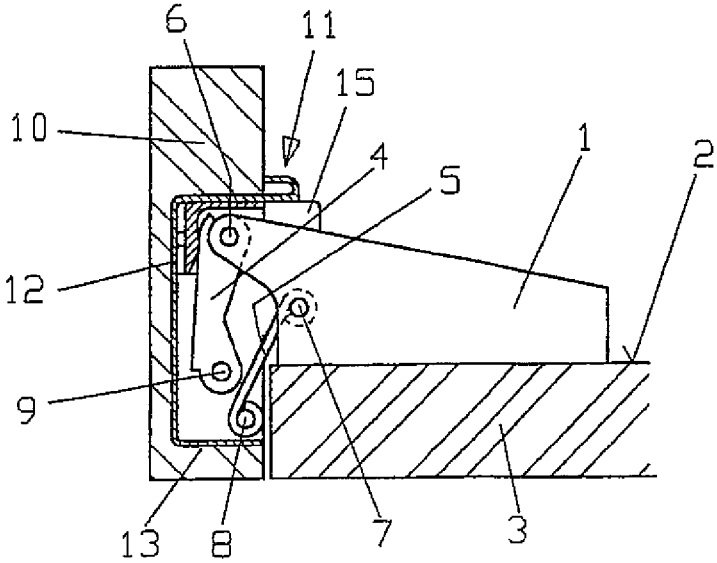

The furniture hinge for which consecutive positions during the closing motion are shown in FIGS. 1-3, is attached to the inside wall 2 of a furniture body 3 by means of a body stop part 1. A door stop part 11 that is attached to a furniture door 10 is articulated by means of joints 8, 9 via two hinge control arms 4, 5 that are arranged on the body stop part 1 in joints 6, 7. The door stop part 11 comprises an insertion cup 12 or a deflection cup that is accommodated in a cup bore 13 of the furniture door 10. One of the hinge control arms 4 hereby forms a pivoting arm, by means of which the door stop part 11 engages in the body stop part 1.

A damping device 14 combined with the furniture hinge comprises two damping cylinders 15 that are connected rigidly via a bridge 16. Each damping cylinder 15 comprises a cylinder housing 17 in which one damping piston (not shown) is arranged and can be axially displaced. A pressure agent (liquid or gas) that streams through damping bores during a piston motion causes a dampening of the piston motion. The piston is connected to a piston rod 18, which extends from the cylinder housing 17 and rests against the floor 19 of the insertion cup 12. The damping cylinder 17 is arranged so as to be mobile in the insertion cup 12.

Figure 7:
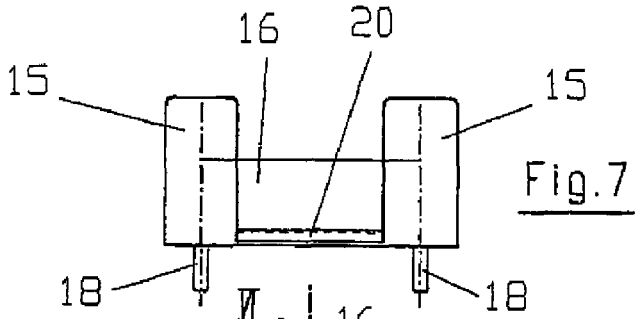
FIG. 7 shows a view in the direction of arrow VII in FIG. 5.
Figure 5:
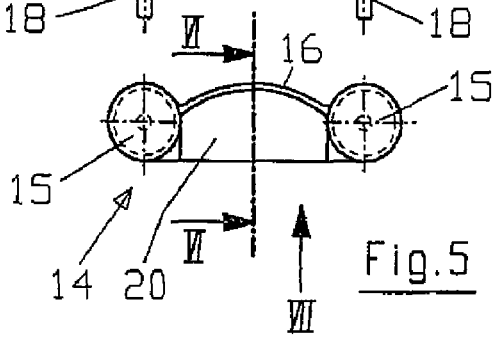
FIG. 5 shows a top view of the damping cylinders connected to one another.
Figure 6:
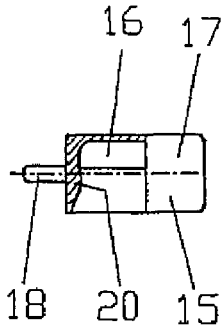
FIG. 6 shows a section along line VI-VI in FIG. 5.

During the closing process the pivoting arm 4 (hinge control arm), as part of its pivoting motion (FIGS. 1-3), rests on a bridge center part 20 of the bridge 16, which is arranged between the two damping cylinders 15 (FIG. 7). When the closing motion is continued to the closed position of the furniture door 10 (FIG. 3), the pivoting arm 4 carries the two damping cylinders 15 with it and the damping force that counteracts the closing force slows down the closing motion of the furniture door 10 until it gently and without slamming rests against the body 3 (FIG. 3).

FIGS. 1-4 show that the two damping cylinders 15 are essentially arranged in the cup bore 13. The cylinder axes of the damping cylinders 15 essentially run perpendicular to the door plane so that the damping force of the motion directly counteracts the furniture door 10.

Figure 4:
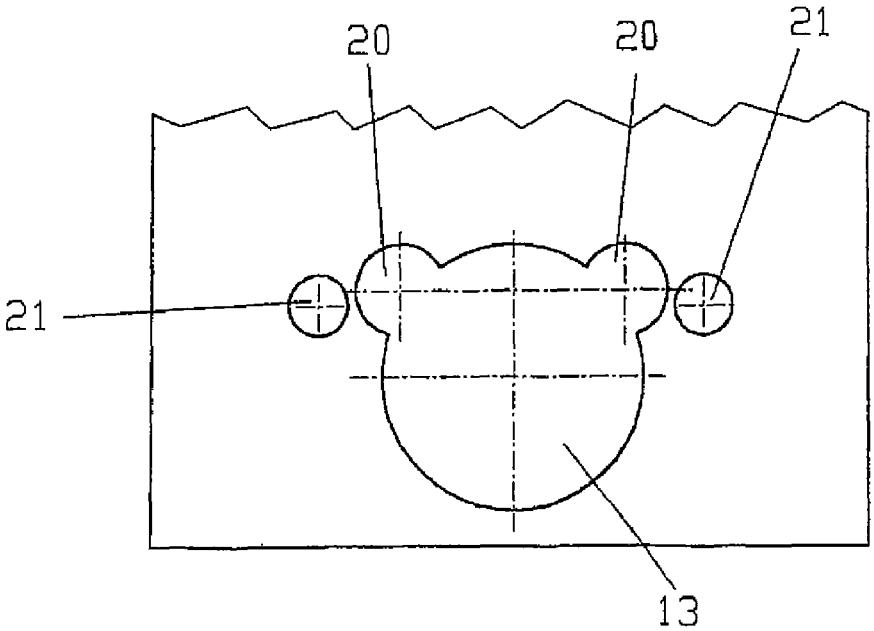
FIG. 4 shows the bore in the furniture door for accommodating the insertion cup of the furniture hinge according to FIGS. 1-3, in the direction of to arrow IV in FIG. 1.
Figure 12:
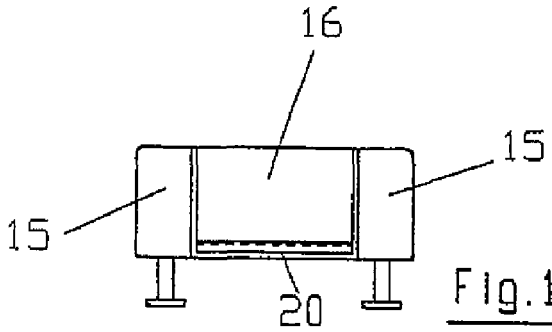
FIG. 12 shows a view in the direction of arrow XII in FIG. 10.
Figure 11:
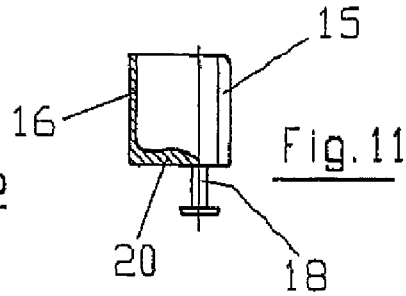
FIG. 11 shows a section along line XI-XI in FIG. 10.
Figure 10:
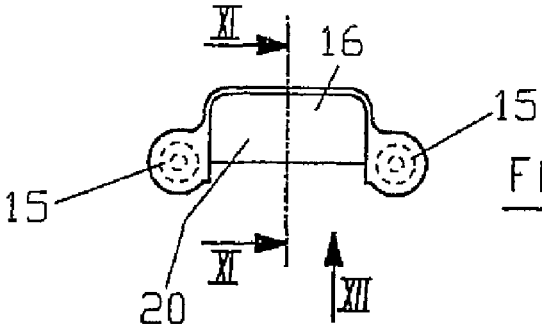
FIG. 10 shows a top view of the damping cylinders for this embodiment that are connected to each other.
Figure 13:
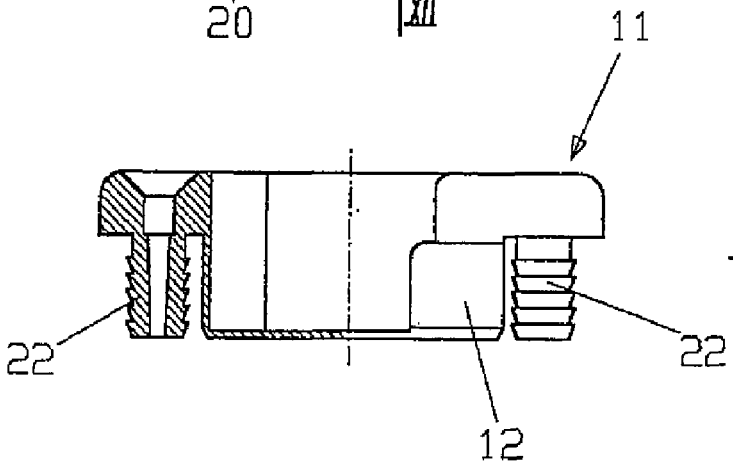
FIG. 13 shows a partial longitudinal section through the respective door stop part.
Figure 9:
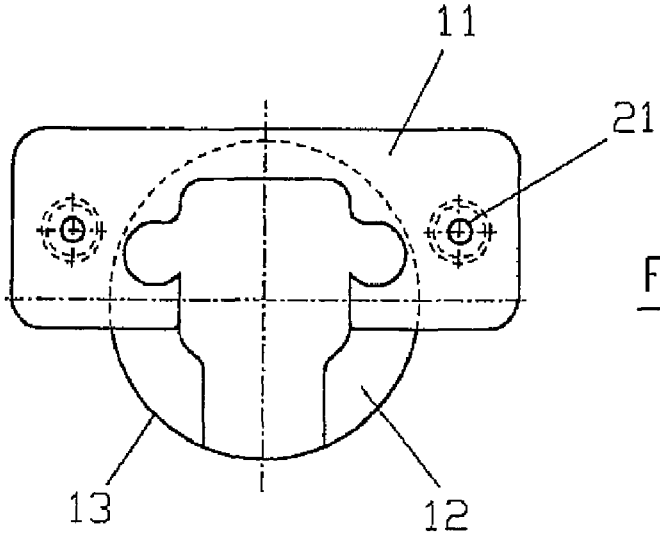
FIG. 9 shows a top view of a door stop part for which, apart from the peg bores, no additional bores are required.
Figure 16:
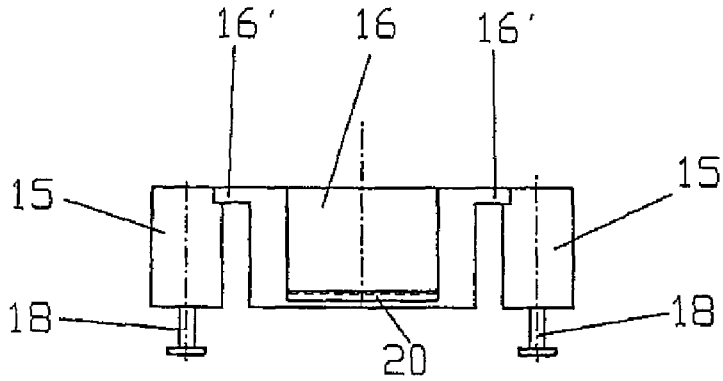
FIG. 16 shows a top view in the direction of arrow XVI in FIG. 15.
Figure 15:
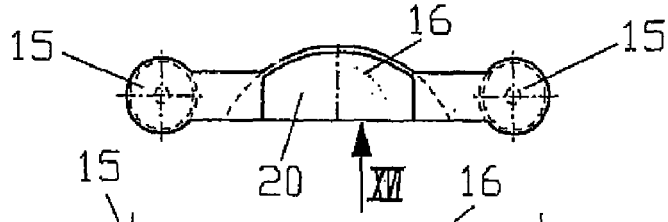
FIG. 15 shows a top view according to FIG. 10.

The image of the bore in the area of the cup bore 13 of the furniture door 10, shown in FIG. 4, shows that the bores 20 that accommodate the damping cylinders 15 overlap with the cup bore 13. Peg bores 21 are arranged on both sides, each accommodating a fastening peg of the door stop part 11.

Figure 8:
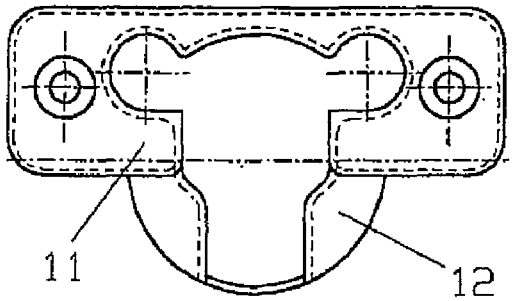
FIG. 8 shows a top view of a door stop part of a modified embodiment of a furniture hinge.

FIG. 8 shows the door stop part 11 prior to being placed in the cup bore 13.

A modified embodiment of a furniture hinge comprises a door stop part whose individual components are shown in FIGS. 9-13. This embodiment is different from the above described embodiment essentially only in that there are no separate bores for accommodating the damping cylinders 15. Here, the damping cylinders 15 are accommodated in the interior of the insertion cup 12 and thus in the respective cup bore 13. The door stop part 11, which is shown in a partial sectional view and a partial view in FIG. 13, comprises fastening pegs 22 on the sides of the insertion cup 12, which are used for fastening purposes in the peg bores 21.

FIGS. 14-17 show parts of the door stop part of another embodiment that is different from the above described embodiments essentially only in that the two damping cylinders 15 that are connected by the bridge 16 each are at least partially arranged in a bore 23 of the fastening peg 22, which is accommodated in the peg bore 21. Thus the two damping cylinders 15 are at least partially arranged in the peg bore 21. Additionally, a screw bore 24 extends into the fastening peg 22 and accommodates a screw for fastening a sheet metal cover (not shown) of the stop part.

Since the two bores that accommodate the two damping cylinders 15 are separated by the cup bore 13, the bridge 16 is connected to the two laterally arranged damping cylinders 15 only via the upper bars 16' in order to allow for an unobstructed insertion motion of the damping cylinders 15 into the bores 23.

The exemplary embodiment shown in FIGS. 19-23 is different from the embodiment according to FIGS. 14-18 essentially in that the two peg bores 21 touch the cup bore 13. The necessary, somewhat wider breakthrough is produced due to material displacement when the insertion cup is pressed in.

The exemplary embodiment shown in FIGS. 24-28 is different from the exemplary embodiment according to FIGS. 1-3 only in that the pivoting arm 4 of the multi-joint furniture hinge acts on the bridge center piece 20 of the bridge 16 between the two damping cylinders 15 via a pivoting flap 25 whose axis is arranged in the same direction as the pivoting arm 4 and engages with the insertion cup 12 (FIGS. 27, 28).

In the embodiment according to FIGS. 29-31 a modified embodiment of the pivoting flap 25' comprises two lateral loops 26 that can rest on the piston rods 18 of the two damping cylinders 15. Here, the cylinder housings 17 of the damping cylinders 15 are arranged in the bores 23 of the fastening pegs 22. The two damping cylinders 15 are in this case only connected via the door stop part 11.

Figure 17:
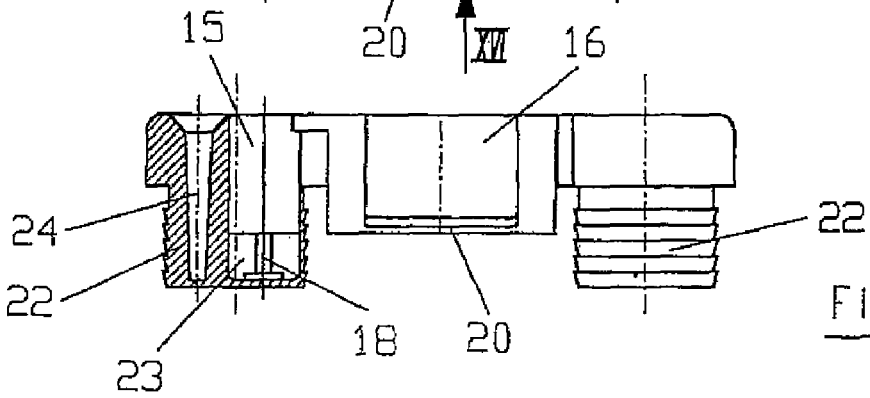
FIG. 17 shows a partial longitudinal section through the respective door stop part with an inserted damping device.
Figure 18:
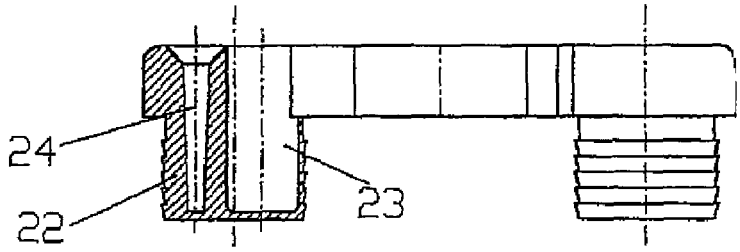
FIG. 18 shows a partial longitudinal section through the plastic component (damping receptacle) of the door stop part according to FIG. 17.
Figure 14:
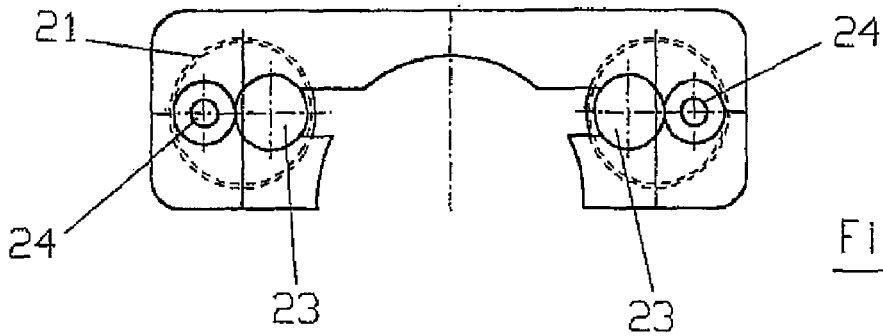
FIG. 14 shows a view corresponding to FIG. 8 of a modified embodiment with a bridge peg.
Figure 34:
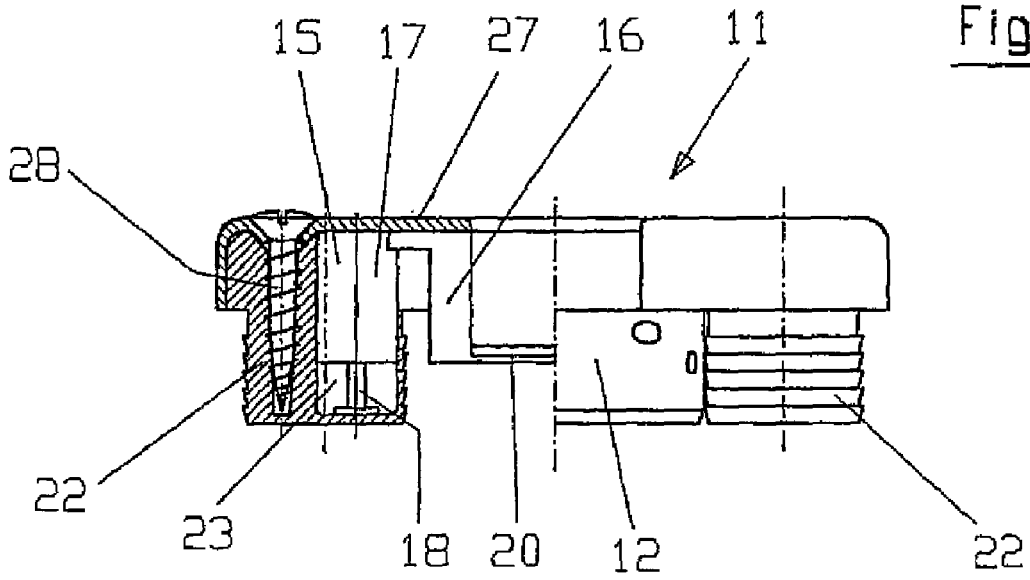
FIG. 34 shows a section according to FIG. 31 of a modified embodiment of a door stop part.

FIG. 34 shows partially a sectional view and partially a view of the assembled components of the door stop part 11 in an embodiment that is similar to FIG. 17. The cylinder housings 17 of the two damping cylinders 15 are connected rigidly via the bridge 16 and the pivoting arm 4 (not shown) acts directly or via a pivoting flap 25 on the center part of the bridge 20 according to FIGS. 27 and 28. The piston rods 18 of the two damping cylinders 15 rest on the bottom of the bores 23 in the fastening pegs 22. A sheet metal or die cast cover 27 is fastened to the plastic interior component of the door stop part 11 via screws 28. The fastening pegs 22 are integrally formed with the insertion cup 12 and are made of plastic; they could also be made separately.

Figure 36:
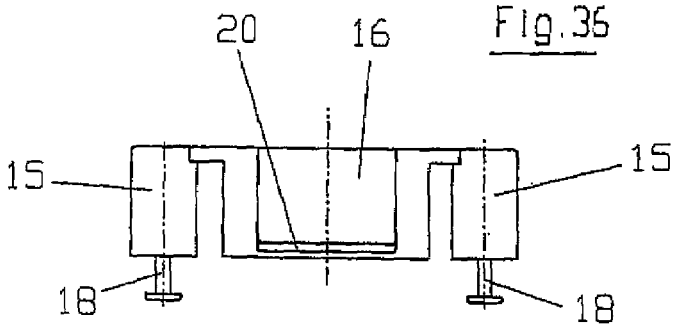
FIG. 36 shows a view in the direction of arrow XXXVI in FIG. 35.
Figure 35:
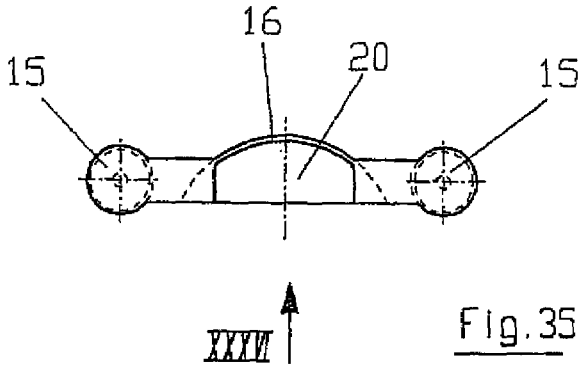
FIG. 35 shows a top view of connected damping cylinders.

FIG. 35 shows a top view of the damping cylinders 15 that are rigidly connected via the bridge, a view of which is shown in FIG. 36.

Figure 37:
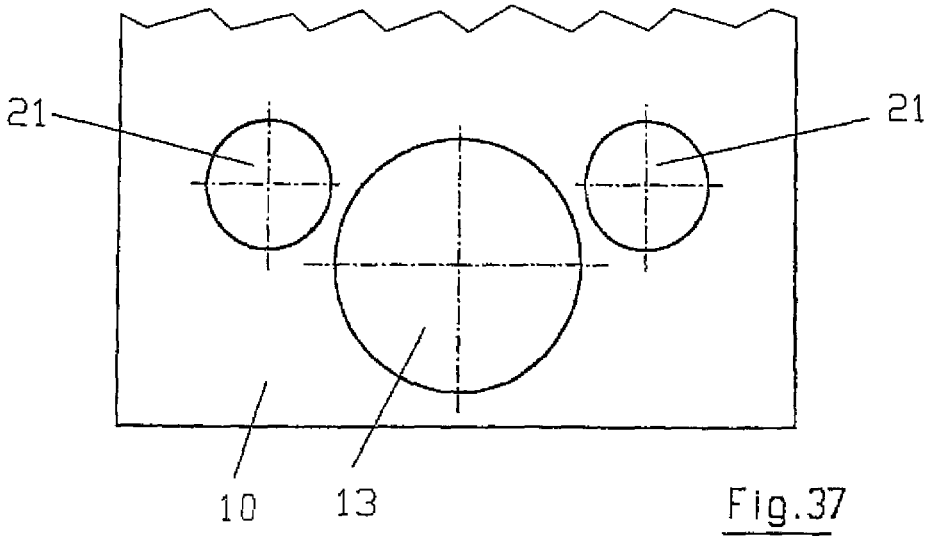
FIG. 37 shows the respective image of the bore according to FIG. 4, FIGS. 38 and 39 each show a horizontal section of a single-joint furniture hinge according to FIG. 1.

FIG. 37 shows the bore of the cup bore 13 and the two peg bores 21 for accommodating the door stop part 11 according to FIG. 34.

Figure 39:
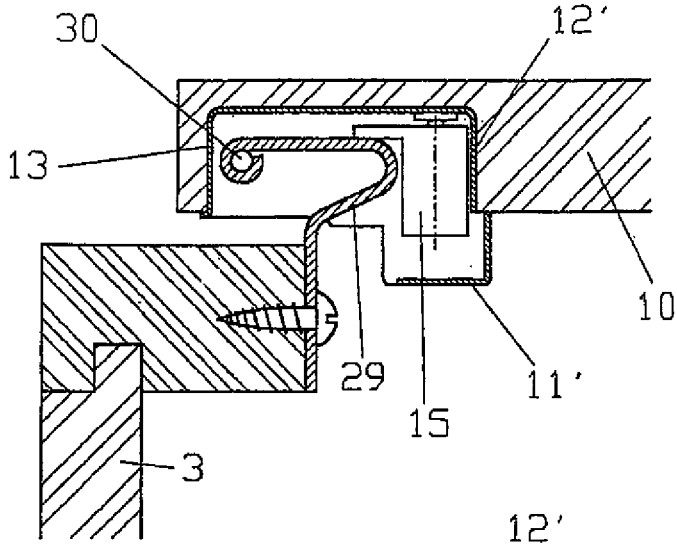
Figure 38:
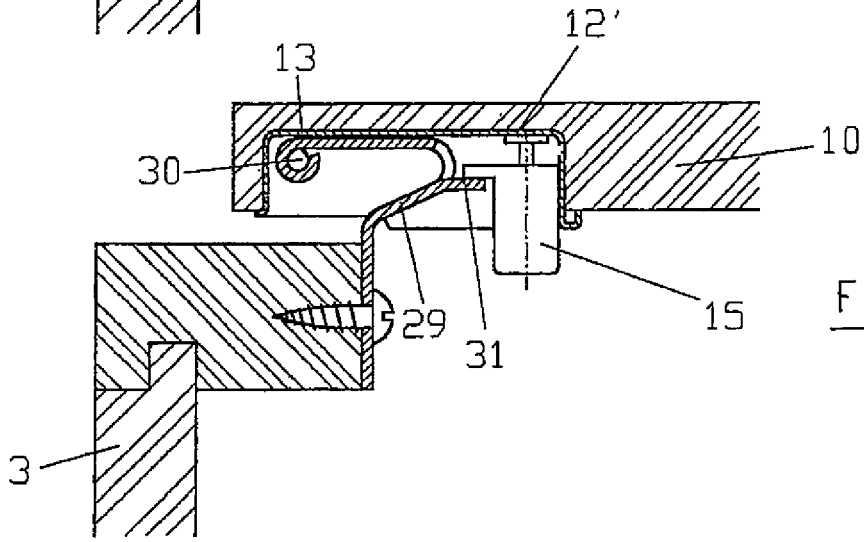

While FIGS. 1-37 show multiple-joint furniture hinges, FIGS. 38 and 39 each show a single-joint furniture hinge between the furniture door 10 and the furniture body 3. Here, a support arm 29 is screwed to the body 3. The door stop part

11' pivots on the support arm 29 in a joint 30 and its insertion cup 12' is accommodated in the cup bore 13 of the furniture door 10.

Here, one or two damping cylinders 15 are arranged in the cup bore 13, with the cylinder axis extending perpendicular to the door plane, and are moved by an arm 31 extending from a support arm 29 (FIG. 38) during the closing motion or by the support arm itself (FIG. 39) at the end of the closing motion of the furniture door IO in order to achieve a damping effect.

Figure 40:
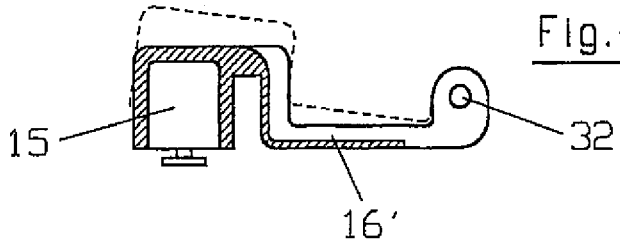
FIG. 40 shows a bridge with only one damping cylinder.

FIG. 40 shows that a bridge 16' similar to the bridge 16 (FIGS. 5-7) is arranged as a pivoting component on one side in a joint bearing 32. The other end rests on one single damping cylinder 15.

Figure 41:
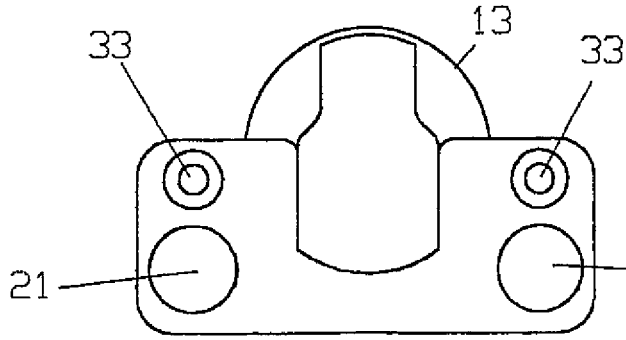
FIG. 41 shows a top view of another embodiment.

FIG. 41 shows larger bores 21' for larger damping cylinders laterally next to the cup bore 13. Screws 33 are used for fastening purposes without any prior bores in the carrier plate.

In all embodiments that are shown the damping cylinders 15 can be removed to decrease the damping effect if multiple furniture hinges are used.

The invention claimed is:

1. A furniture hinge comprising a door stop part comprising an insertion cup adapted to be attached to a furniture door, the insertion cup having an open top end and a bottom floor, and an axis extending in a first direction perpendicularly to the floor of the cup, a side wall of the insertion cup extending around an entire periphery of the open top end, being pivotable connectable to a furniture body, and a damping device having at least one damping cylinder engaged with the door stop part , each damping cylinder being adapted to be arranged at least partially in a bore of the furniture door so that a cylinder axis of the damping cylinder extends generally in the first direction, wherein the damping cylinder is arranged to be moved by the pivoting arm when the door is moved relative to the furniture body to a closed position of the furniture door.

2. The furniture hinge according to claim 1, wherein the damping device comprises two parallel damping cylinders.

3. The furniture hinge according to claim 2, wherein the pivoting arm is one of the two hinge control arms of a multi-joint furniture hinge.

4. The furniture hinge according to claim 2, wherein the pivoting arm is a support arm of a single-joint furniture hinge arranged on the insertion cup.

5. The furniture hinge according to claim 2, wherein the two damping cylinders are adapted to be at least partially arranged in a cup bore in the furniture door that accommodates the insertion cup.

6. The furniture hinge according to claim 2, wherein the two damping cylinders are adapted to be at least partially arranged in a bore of the furniture door next to the cup bore.

7. The furniture hinge according to claim 6, wherein the bores that accommodate the damping cylinders overlap with the cup bore.

8. The furniture hinge according to claim 6, wherein the bores that accommodate the damping cylinders are separate from the cup bore.

9. The furniture hinge according to claim 2, wherein the two damping cylinders are adapted to be at least partially arranged in a peg bore, which accommodates a fastening peg of the door stop part.

10. The furniture hinge according to claim 2, wherein the two damping cylinders are connected rigidly by a bridge, which has a bridge center part arranged between the two damping cylinders, on which the pivoting arm acts when pivoting into the closed position.

11. The furniture hinge according to claim 10, wherein the pivoting arm acts on the damping cylinders by means of a pivoting flap whose axis is arranged in the same direction as the pivoting arm and is arranged on the insertion cup in a pivoting manner.

12. The furniture hinge according to claim 11, wherein the pivoting flap pivots against the bridge center part.

13. The furniture hinge according to claim 11, wherein the pivoting flap has two lateral loops that can rest on the two damping cylinders.

14. The furniture hinge according to claim 1, wherein the pivoting arm is one of the two hinge control arms of a multi-joint furniture hinge.

15. The furniture hinge according to claim 1, wherein the pivoting arm is a support arm of a single-joint furniture hinge arranged on the insertion cup.

16. The furniture hinge according to claim 1, wherein the two damping cylinders are adapted to be at least partially arranged in a cup bore in the furniture door that accommodates the insertion cup.

17. The furniture hinge according to claim 1, wherein the two damping cylinders are adapted to be at least partially arranged in a bore of the furniture door next to the cup bore.

18. The furniture hinge according to claim 1, wherein the two damping cylinders are adapted to be at least partially arranged in a peg bore, which accommodates a fastening peg of the door stop part.

19. The furniture hinge according to claim 1, wherein the two damping cylinders are connected rigidly by a bridge, which has a bridge center part arranged between the two damping cylinders, on which the pivoting arm acts when pivoting into the closed position.

20. The furniture hinge according to claim 1, wherein the pivoting arm acts on the damping cylinders by means of a pivoting flap whose axis is arranged in the same direction as the pivoting arm and is arranged on the insertion cup in a pivoting manner.

* * * * *